United States Patent [19]

Swierczek

[11] Patent Number: 5,024,014

[45] Date of Patent: Jun. 18, 1991

[54] INTEGRAL LABEL AND COASTER

[76] Inventor: Remi D. Swierczek, 6399 Ledge Lake Ct., Concord, Ohio 44077

[21] Appl. No.: 453,250

[22] Filed: Dec. 20, 1989

Related U.S. Application Data

[63] Continuation-in-part of Ser. No. 349,051, May 8, 1989, abandoned.

[51] Int. Cl.[5] ..... G09F 3/00

[52] U.S. Cl. ..... 40/310; 206/217; 215/100.5

[58] Field of Search ..... 40/306, 310, 312; 215/100.5; 206/460, 831, 216, 217, 601; 220/85 SP, 83; 248/346.1

[56] References Cited

U.S. PATENT DOCUMENTS

| | | | |
|---|---|---|---|
| 2,950,040 | 8/1960 | Bolding | 40/312 |
| 3,037,682 | 6/1962 | Daubert | 206/217 |
| 3,040,472 | 6/1962 | Miller | 248/346.1 |
| 3,110,121 | 11/1963 | Corrinet | 40/312 |
| 3,300,041 | 1/1967 | Fuller | 206/217 |
| 3,835,564 | 9/1974 | Gottschalk | 40/306 |
| 4,621,442 | 11/1986 | Mack | 40/312 |

*Primary Examiner*—Kenneth J. Dorner
*Assistant Examiner*—J. Hakomaki
*Attorney, Agent, or Firm*—Oldham & Oldham Co.

[57] ABSTRACT

A label for use on a beverage container. The label consists of a coaster attached to the conventional label or directly to the container by adhesive. In the preferred embodiment an edge or a corner of the label has no adhesive to accommodate easy peeling of the coaster from the container. The adhesive allows for firm attachment of the label to the container or another label while at the same time retains stickiness to flatly adhere to the protected surface.

12 Claims, 2 Drawing Sheets

INTEGRAL LABEL AND COASTER

This application is a continuation-in-part of application Ser. No. 07/349,051, Filed on May 8, 1989 now abandoned.

FIELD OF INVENTION

The present invention relates to a label that can be separated from the bottle or container for use as a coaster.

BACKGROUND OF THE INVENTION

The present invention relates to the protection of furniture and the like from the container condensation and dripping. When a bottle is taken from the refrigerator, for example, a coaster may be used to insulate tablecloth or furniture from the condensation on the outside surface of the bottle.

Many attempts have been made to provide a coaster as part of the bottle or can packaging. These prior art devices, U.S. Pat. Nos. 657,327, 2,955,722, 3,202,448, 3,350,131, and 4,061,244 have either not been convenient or easily manufactured.

Williams, U.S. Pat. No. 657,327, provides protection of an underlying surface with an absorbent collar. The collar work because it absorbs the unwanted dripping before it reaches the side of the bottle. The collar fails to protect against condensation on the side and bottom surfaces of the bottle. Williams would not readily work on a straight sided can. It relies on the large diameter portion of the bottle to hold the collar up.

Stern et al., U.S. Pat. No. 3,202,448 and Tanzer, U.S. Pat. No. 3,350,131 each disclose a carrier that can be broken into smaller units for use as an individual coaster.

These devices are convenient because a coaster is provided with the container. The carrier is limited however to the dimensions of the container because the carrier is attached to the top of the container. Both Stern and Tanzer provide round coasters with substantial side walls on the coaster. Neither can be adapted for use as a label on the side of the container.

Tucker, U.S. Pat. No. 4,061,244 and Antonious, U.S. Pat. No. 2,955,722 both disclose similar closures that are used in combination as coasters. The closure is attached to the beverage container to seal the container after it has been filled. When opening the container, the closure is removed, turned upside down and used as a cup to contain any dripping. The problem with these formed closures is that both require an elaborate manufacturing process and are cost-prohibitive.

Buske, U.S. Pat. No. 3,524,782 shows a coupon protective covering means. The cover is formed with perforated lines that are broken to gain access to the coupon underneath. Buske discloses and purposely provides for inconvenient access to the coupon to avoid theft and vandalism. A cutting tool is required to cut along the already perforated lines.

A similar label is disclosed in Miller, U.S. Pat. No. 3,702,511. In addition to perforated lines, the removeable portion of the label is attached with a soluble glue. Miller requires running hot water or some other liquid over the coupon to release the coupon from the glue. Both Miller and Buske are specifically designed to be difficult to remove.

SUMMARY OF THE INVENTION

The present invention consists of a combination label and coaster for use on a beverage container. The label coaster is attached to the container using a releasable adhesive. The label coaster can be attached directly to the beverage container or can be placed over a conventional label.

When the beverage is to be consumed, the label coaster is removed and placed on the surface to be protected. The beverage container can then be placed upon the coaster and any condensation on the container will not damage the surface being protected.

The label coaster typically has the logo of the beverage producer along with other typical identifying information imprinted upon it. The label coaster can be manufactured for a single use or can be made from more substantial material and be used many times.

DETAILED DESCRIPTION OF THE INVENTION

Figure 1:
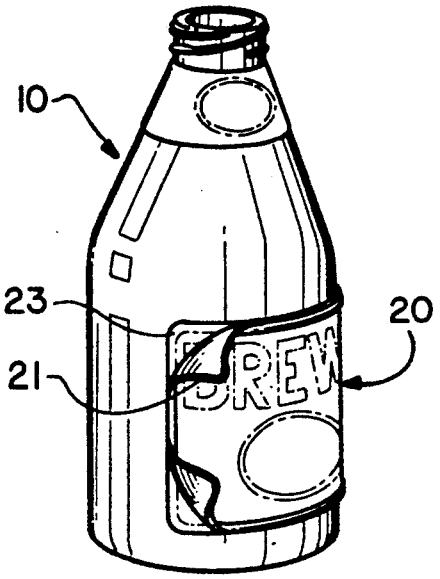
FIG. 1 is a front view of a beverage bottle showing a label coaster applied to the bottle over a previously existing label. Corners of the label coaster has been peeled away from the bottle.

Referring to FIG. 1, a beverage container 10 is shown with a label coaster 20 of the present invention applied to the beverage container 10. FIG. 1 shows a bottle. The label coaster 20 can also be used with a beverage can.

The label coaster 20 consists of a label made from paper having a high wet strength such as wax coated paper. The label coaster 20 can also be formed from plastic films or a metal and paper laminate. The paper should be water resistant to protect the surface from condensation accumulating on the label coaster 20.

In one embodiment, the label coaster 20 is adhesively affixed to the beverage container using an adhesive that will release the label coaster 20 from the beverage container 10 when a corner or edge 21 of the label coaster 20 is pulled away from the bottle as shown in FIG. 1. The adhesive must be compatible with material surfaces typically present in consumer products so as not to damage the surface when the label coaster 20 is removed and placed on that surface.

When the label coaster 20 is formed from very thin material, it has a tendency to curl when removed from the beverage container 10. This curling would prevent the label coaster 20 from being used as a coaster. To overcome the tendency to curl, an adhesive should be used which retains some adhesive properties after the label coaster 10 has been removed from the beverage container 10. This residual adhesiveness will cause the label coaster 20 to stick to the surface being protected rather than curl up.

"Tack a Note" TM Adhesive Stick manufactured by Dennison Manufacturing Co. is an adhesive that retains some adhesive properties after the label coaster 20 has been removed from the beverage container 10.

The label coaster 20 would typically contain the beverage producer's logo and other identifying information. The label coaster 20 can be applied directly to the beverage container 10 in place of the typical label. The label coaster 20 can also be applied over the typical label 23 as shown in FIG. 1.

In another embodiment of the present invention, a releasable adhesive is applied to the label area of the beverage container 10. The back side of the label coaster 20 is coated with a releasable coating such as silicone. The entire label coaster 20 may be coated with the releasable coating. This is particularly advantageous when the coating is water resistant. This increases the life of the label coaster 20 when being used as a coaster.

Figure 2:
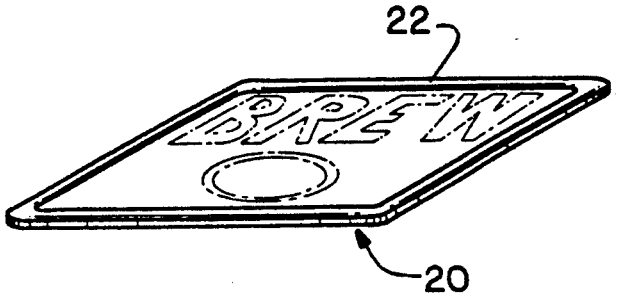
FIG. 2 is a perspective view of a label coaster removed from the bottle.

The label coaster 20 can be provided with a small ridge 22 as shown in FIG. 2. These ridges 22 prevent the spill of water from the label coaster 20 that has accumulated from prolonged condensation on the side of the beverage container 10.

Another version of the label coaster 20 is formed from absorbent material rather than water resistant material. This version protects the surface the beverage container 10 is placed upon by absorbing the condensation in addition to containing the condensation. Typically the absorbent material is coated on its back side with a releasable coating such as silicon. The releasable adhesive would then be applied to the beverage container 10.

Figure 3:
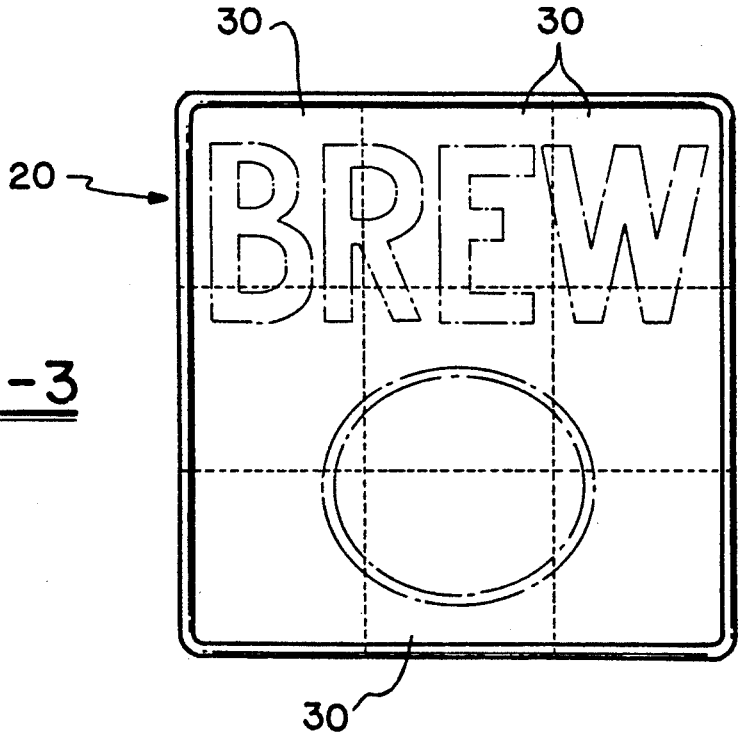
FIG. 3 shows a label coaster for use on large beverage containers.
Figure 4:
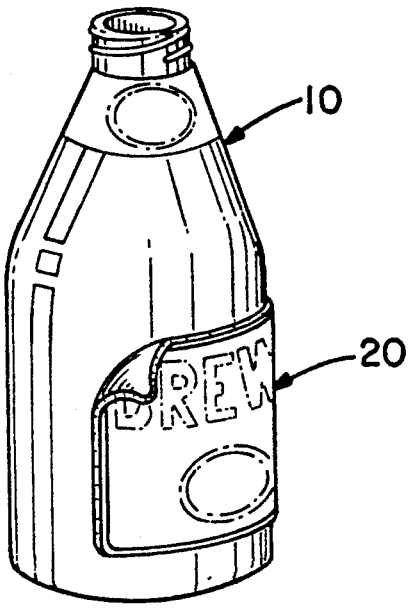
FIG. 4 is a front view of a beverage bottle showing a label coaster applied to the bottle. One corner of the label coaster has been peeled away from the bottle.
Figure 5:
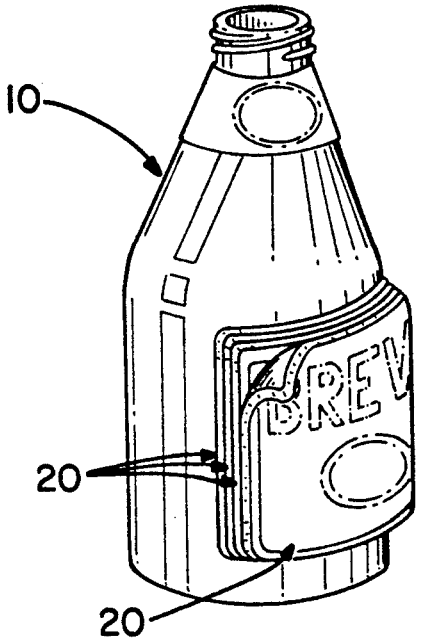
FIG. 5 is a front view of a beverage bottle showing a plurality or pocket of labels applied to the bottle.
Figure 6:
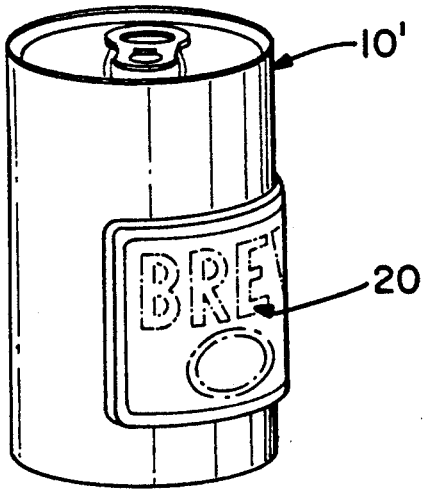
FIG. 6 is a front view of a beverage can showing a label coaster applied to the can.

For larger beverage containers such as a two liter bottle, the label coaster 20 can consist of a plurality of coasters 30 formed in one piece as shown in FIG. 3. The label coaster 20 is scored or perforated to allow separation of the label coaster 20 into smaller individual coaster 30. This is advantageous for larger beverage containers where several persons may be consuming the beverage using individual glasses. Since the label coaster 20 can contain printed material on both sides, each individual coaster 30 can be printed with the beverage producer's logo and identifying information.

In another embodiment of the present invention also used for larger beverage containers, several label coasters 20 are laminated together using a releasable adhesive and attached to the beverage container 10 as described above. The label coasters 20 are then removed one at a time as needed for use with individual servings poured from the large beverage container. Each individual label coaster 20 can contain the logo and identifying information of the beverage producer.

Therefore, it is a primary object of the present invention to provide a label that can be detached from the container for use as a coaster.

I claim:

1. In combination with a beverage container a label/coaster device comprising:

(a) a label/coaster having a first side directed toward said container and a second side directed out and away from said container wherein at least one surface of said label/coaster being resistant to water;

(b) adhesive means disposed on a substantial portion of said first side of said label/coaster for removably securing said label/coaster to said beverage container, said adhesive means providing for easy removal of said label/coaster without damage to said label/coaster; and (c) said label/coaster having printed matter on at least said second side thereof.

2. A label/coaster device as in claim 1 wherein said label/coaster contains a raised portion adjacent its periphery on at least on side of said label/coaster.

3. A label/coaster device as in claim 1 wherein at least one surface of said label/coaster being formed of water absorbent material.

4. A label/coaster device as in claim 1 wherein said label/coaster consists of multiple portions and in which said label/coaster is perforated between adjacent portions.

5. A label/coaster device as in claim 1 in which said beverage container has a label of conventional design secured to said beverage container and said label/coaster is secured to said conventional label.

6. A label/coaster device as in claim 5 wherein said conventional label having a release agent coated thereon to facilitate removal of said label/coaster.

7. A label/coaster as in claim 1 wherein said adhesive means in not applied to selected areas under said label/coaster to facilitate removal of said label/coaster.

8. A label/coaster as in claim 1 wherein said beverage container having a release agent coated hereon to facilitate removal of said label/coaster.

9. A label/coaster device as recited in claim 1 wherein said beverage container is a bottle.

10. A label/coaster device as recited in claim 1 wherein said beverage container is a can.

11. In combination with a beverage container, a label/coaster device comprising:

(a) a plurality of labels/coasters each having a first side directed toward said container and a second side directed out and away from said container wherein at least one side of each label/coaster being resistant to water;

(b) adhesive means disposed on a substantial portion of said first side of each said label/coaster for removably securing said labels/coasters one on top of the other to form a plurality of labels and said adhesive means also secures said plurality of labels/coasters to said beverage container, said adhesive means providing for easy removal of a label/coaster one at a time without damage to the remaining labels/coasters; and (c) each said label/coaster having printed matter on at least said second side thereof.

12. A label/coaster device as in claim 9 in which said beverage container has a label of conventional design secured to said beverage container and said plurality of labels/coasters is secured to said conventional label.

* * * * *